US008471727B2

(12) United States Patent
Batsakes et al.

(10) Patent No.: US 8,471,727 B2
(45) Date of Patent: Jun. 25, 2013

(54) METHOD, APPARATUS AND COMPUTER PROGRAM PRODUCT FOR DISPLAYING FORECAST WEATHER PRODUCTS WITH ACTUAL AND PREDICTED OWNSHIP

(75) Inventors: Peter J. Batsakes, Seattle, WA (US); Robert P. Smith, Clinton, WA (US); David E. Stulken, Mercer Island, WA (US)

(73) Assignee: The Boeing Company, Chicago, IL (US)

( * ) Notice: Subject to any disclaimer, the term of this patent is extended or adjusted under 35 U.S.C. 154(b) by 675 days.

(21) Appl. No.: 12/611,296

(22) Filed: Nov. 3, 2009

(65) Prior Publication Data

US 2011/0102192 A1 May 5, 2011

(51) Int. Cl.
*G08G 1/09* (2006.01)

(52) U.S. Cl.
USPC ..... 340/905

(58) Field of Classification Search
USPC ..... 340/905, 971, 945; 701/10, 14
See application file for complete search history.

(56) References Cited

U.S. PATENT DOCUMENTS 5,999,882 A * 12/1999 Simpson et al. ..... 702/3
6,289,277 B1 * 9/2001 Feyereisen et al. ..... 701/528
6,603,405 B2 8/2003 Smith
6,845,324 B2 1/2005 Smith
7,724,177 B2 * 5/2010 Bunch et al. ..... 342/26 R
8,085,182 B2 * 12/2011 Kauffman ..... 342/26 B
2007/0159355 A1 * 7/2007 Kelly et al. ..... 340/905
2009/0109065 A1 4/2009 Pinheiro

OTHER PUBLICATIONS

European Search Report for Application No. EP 10 18 8617 dated Feb. 15, 2011.

European Union, *FLYSAFE Project*, http://www.eu-flysafe.org (includes Project, Overview, Objectives, Aviation Hazards, Weather, Traffic, Terrain, FlySafe Systems, NGISS, WIMS), (visited Sep. 8, 2009).

* cited by examiner

*Primary Examiner* — Phung Nguyen
(74) *Attorney, Agent, or Firm* — Alston & Bird LLP

(57) ABSTRACT

A method, apparatus and computer program product are provided for displaying forecast weather products in relation to a planned flight path of an air vehicle. The method, apparatus and computer program product may display a representation of future weather conditions along with the planned flight path of the air vehicle and a representation of the anticipated location of the air vehicle during the time period during which the future weather forecast is valid in order to provide context for the future weather information. Additionally, the method, apparatus and computer program product may display the weather information as well as information regarding the time period during which the weather information is valid in a graphical manner that is intuitive to the crew of the air vehicle so as not to distract or otherwise increase the workload upon the crew.

16 Claims, 6 Drawing Sheets

FIG. 1
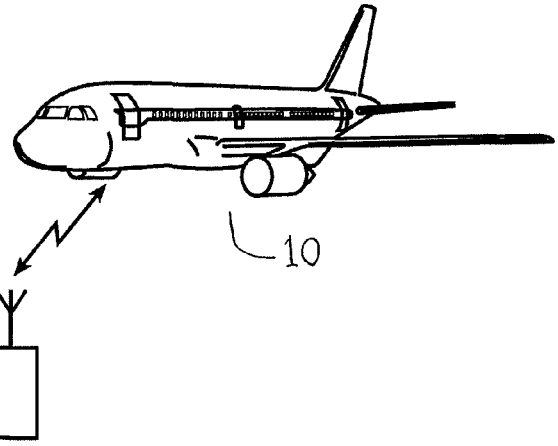
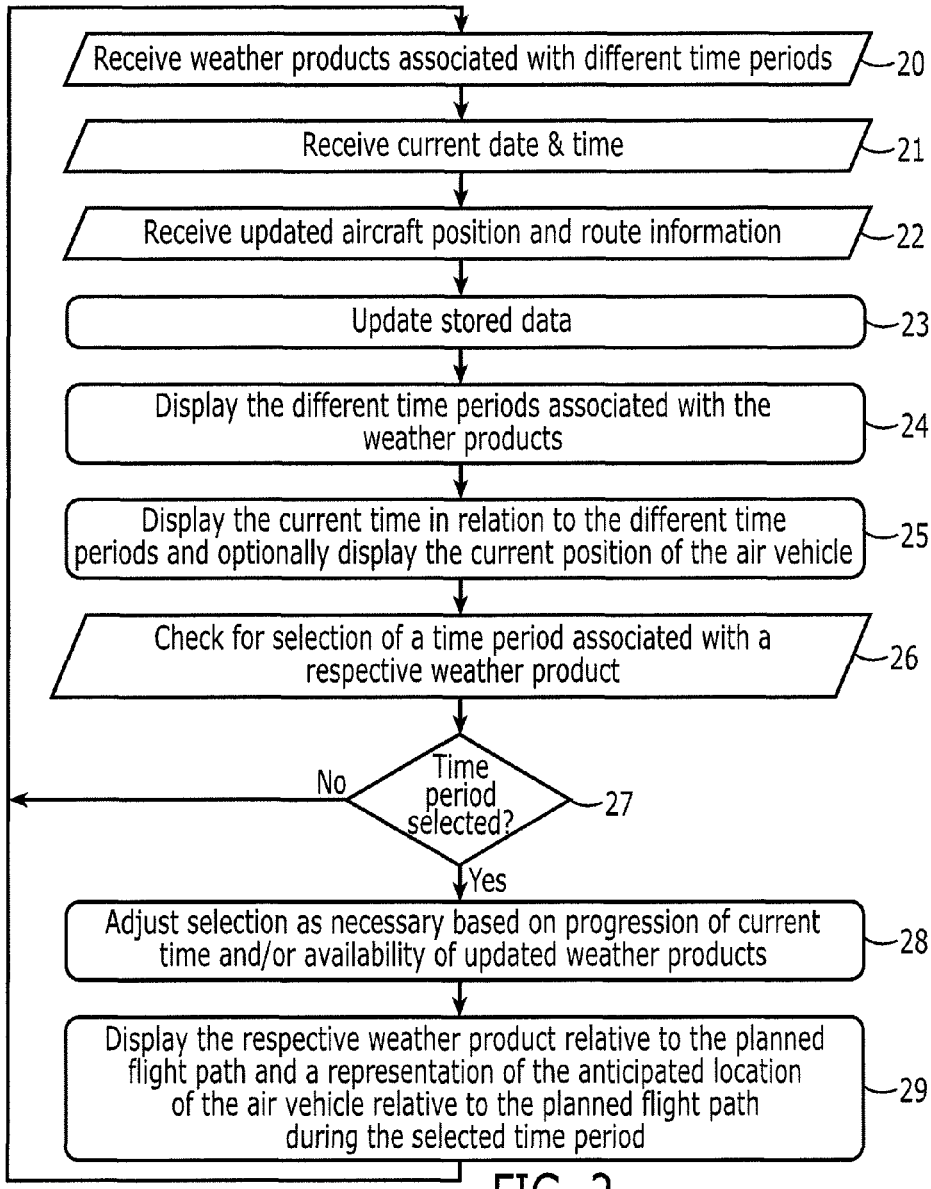
FIG. 2

METHOD, APPARATUS AND COMPUTER PROGRAM PRODUCT FOR DISPLAYING FORECAST WEATHER PRODUCTS WITH ACTUAL AND PREDICTED OWNSHIP

TECHNOLOGICAL FIELD

Embodiments of the present disclosure relate generally to the display of information onboard an air vehicle and, more particularly, to the display of forecast weather onboard an air vehicle.

BACKGROUND

Prior to and during flight, it is desirable for the crew of an air vehicle to have information regarding the weather conditions along the planned flight path. Based upon the weather forecast, the crew may take appropriate actions, such as by altering the planned flight path to avoid or minimize the effects of the weather conditions or by altering the manner in which the aircraft is a operated, such as by changing speed and/or altitude, to counter the effects of the weather conditions.

The crew of an aircraft generally receives information regarding a weather forecast prior to a departure of the flight. The crew can examine the forecasted weather conditions and then take into account those forecast weather conditions during the subsequent flight. The information regarding the weather forecast may be provided in various forms, such as textual information coupled, in some instances, with a visual or other graphical representation of the forecasted weather conditions.

Once the aircraft is en route, the weather forecast may be updated so as to take into account changes in the weather forecast and to otherwise provide updated weather information. Since weather forecasts are generally only reliable and therefore valid for some period of time following their generation as a result of the changes in the weather conditions that may occur over time, the time period for which a weather forecast will remain valid is also generally provided, such as in text that accompanies the weather forecast. However, managing the forecast data and integrating that data into situational awareness of the predicted flight impact may disadvantageously increase the workload on the crew.

It would therefore be desirable to provide an improved technique for providing weather forecasts to the crew of an air vehicle. In this regard, it would be desirable to provide an improved technique for providing weather information in a manner that is intuitive and that does not meaningfully increase the workload upon the crew. Additionally, it would be desirable to provide an improved technique for providing weather information to the crew of an air vehicle such that the crew is advised, not only of the current weather conditions, but also future weather conditions.

BRIEF SUMMARY

A method, apparatus and computer program product for displaying forecast weather products with respect to a predicted position of an air vehicle are therefore provided according to embodiments of the present disclosure. in this regard, the method, apparatus and computer program product may display a representation of future weather conditions along with a representation of the anticipated location of the air vehicle during the time period during which the future weather forecast is valid in order to provide context for the future weather information. Additionally, the method, apparatus and computer program product of embodiments of the present disclosure may display the weather information as well as information regarding the time period during which the weather information is valid in a graphical manner that is intuitive to the crew of the air vehicle so as not to distract or otherwise increase the workload upon the crew.

In one embodiment, a method of displaying forecast weather products is provided. The method of this embodiment receives a plurality of weather products with each weather product being associated with a different time period. The method of this embodiment also provides for the display of a representation of the different periods associated with the plurality of weather products and then receives a selection of a time period associated with a respective weather product. The method of this embodiment then provides for a display of a representation of the respective weather product as well as a representation of the anticipated location of the air vehicle relative to the planned flight path during the time period that has been selected. In some embodiments, the method may also provide for the display of a representation of the current location of the air vehicle relative to the planned flight path. By providing for the display of both a weather product and the anticipated location of the air vehicle during a selected time period, the crew of the air vehicle can quickly gather information about the potential impact of the weather conditions upon the flight, not only at the current time, but at future times along the planned flight path. Indeed, the representation of the air vehicle may provide contextual information regarding the anticipated location of the air vehicle to the weather product during each of a number of different time periods.

In another embodiment, an apparatus for displaying forecast weather products is provided. The apparatus includes a memory configured to store a plurality of weather products associated with different time periods. The apparatus also includes a processor, responsive to the memory, configured to provide for the display of a representation of the different time periods associated with the plurality of weather products. The processor is also configured to receive a selection of a time period associated with a respective weather product and to provide for the display of a representation of the respective weather product. In order to provide context to the representation of the respective weather product, the processor may also provide for the display of the representation of an anticipated location of the air vehicle relative to the planned flight path during the time period that has been selected. The processor of one embodiment may also be further configured to provide for the display of a representation of the current location of the air vehicle relative to the planned flight path.

In a further embodiment, a computer program product for displaying forecast weather products is provided. The computer program product includes at least one computer-readable storage unit having computer-readable program code portions stored therein that in response to execution by a processor, cause an apparatus to receive a plurality of weather products associated with different time periods. The computer readable program code portions are also configured, in response to execution by a processor, to cause the apparatus to provide for the display of a representation of the different time periods associated with the plurality of weather products and to receive a selection of a time period associated with a respective weather product. Further, the computer-readable program code portions, in response to execution by a processor, further cause the apparatus to provide for the display of a representation of a respective weather product and a representation of an anticipated location of the air vehicle relative to the planned flight path during the time period that has been selected.

In one embodiment, the display of a graphical representation of the current time in relation to the representation of the different time periods associated with the plurality of weather products may also be provided. In addition, the display of a graphical representation of a forecast time in relation to the representation of the different time periods associated with the plurality of weather products may also be provided with the forecast time being associated with the time period associated with the weather product being displayed. In this regard, an input moving the graphical representation of the forecast time relative to the representation of the different time periods associated with the plurality of weather products may be received. In response to this input, movement of the representation of the anticipated location of the air vehicle may be provided along the planned flight path based upon and in correspondence to the movement of the graphical representation of the forecast time.

In conjunction with the display of the representation of the different time periods, different graphical indicia may be associated with the representations of different time periods to provide different graphical representations of a time period for which a respective weather product is available and of another time period for which the respective weather product is unavailable. The time periods associated with the plurality of weather products may have different lengths. As such, the display of the representation of the different time periods may include a graphical representation of the different lengths of the time periods associated with the plurality of weather products.

In regard to the receipt of a plurality of weather products, at least two sets of weather products may be received at respective times. In this regard, the weather product of one set associated with a respective time period may be inserted into another subsequent set to serve as a weather product associated with the same respective time period in instances in which the subsequent set of weather products that is received fails to include a weather product associated with the respective time period.

BRIEF DESCRIPTION OF THE SEVERAL VIEWS OF THE DRAWINGS

Figure 3:
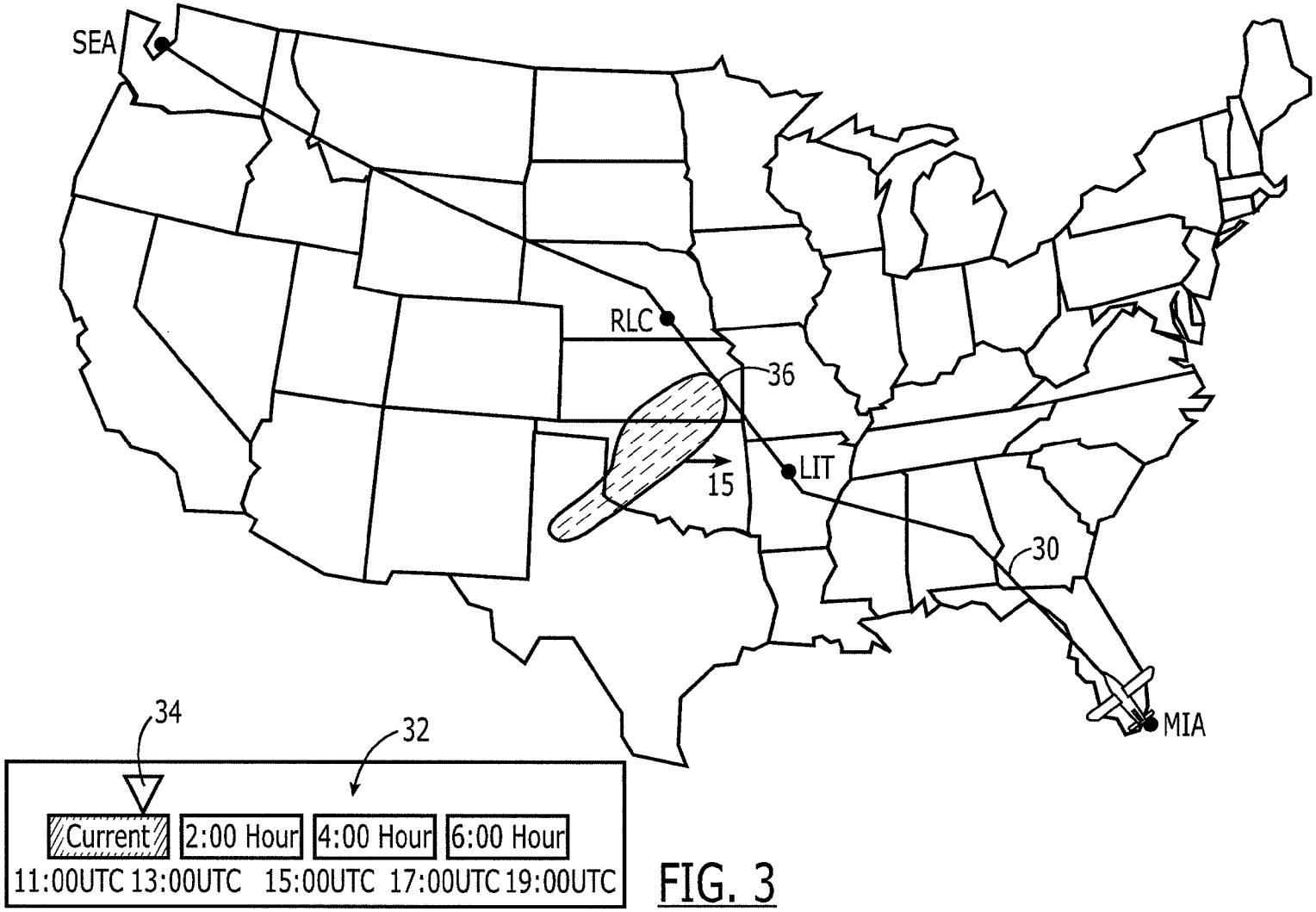
Figure 4:
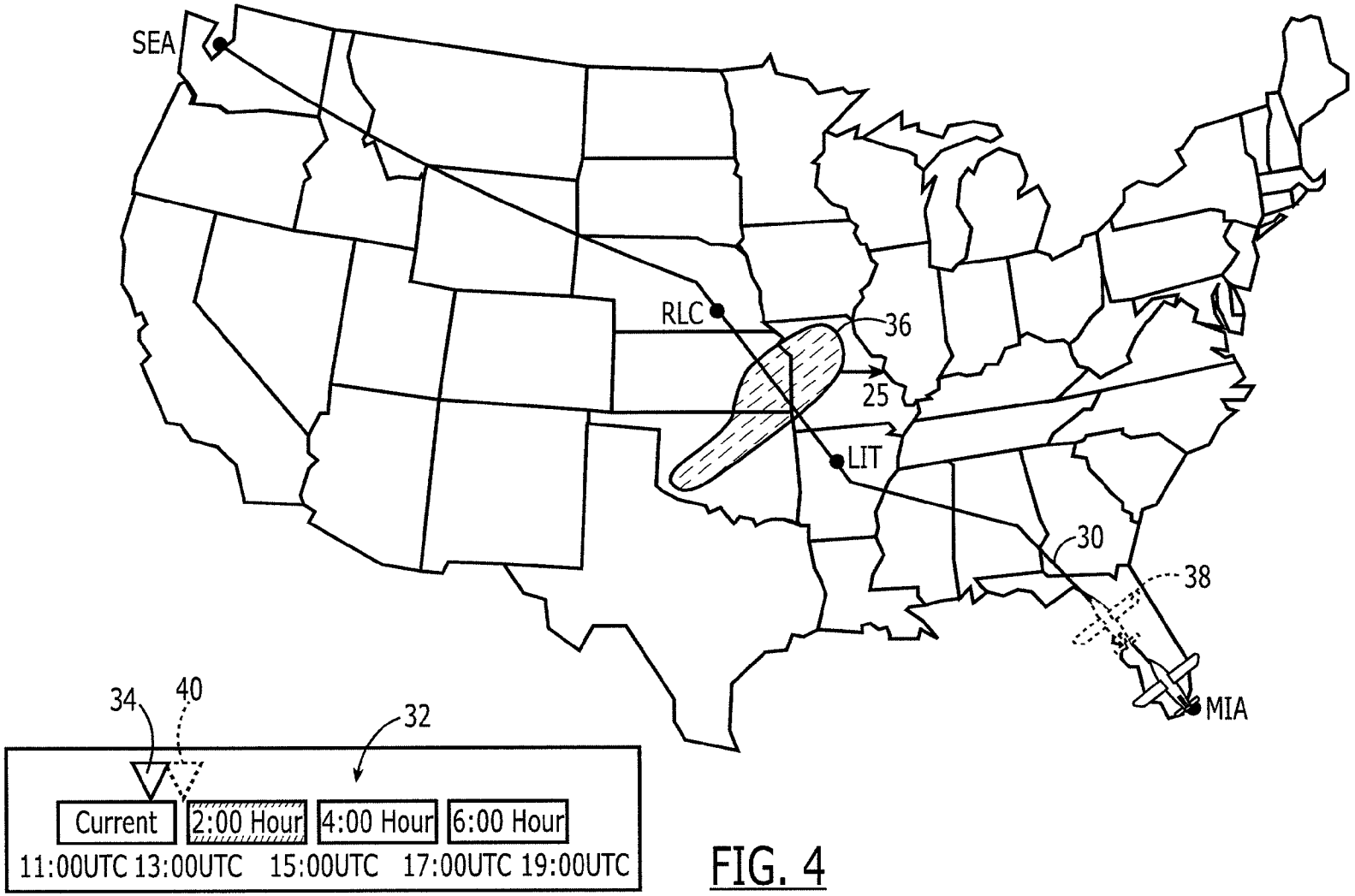
Figure 5:
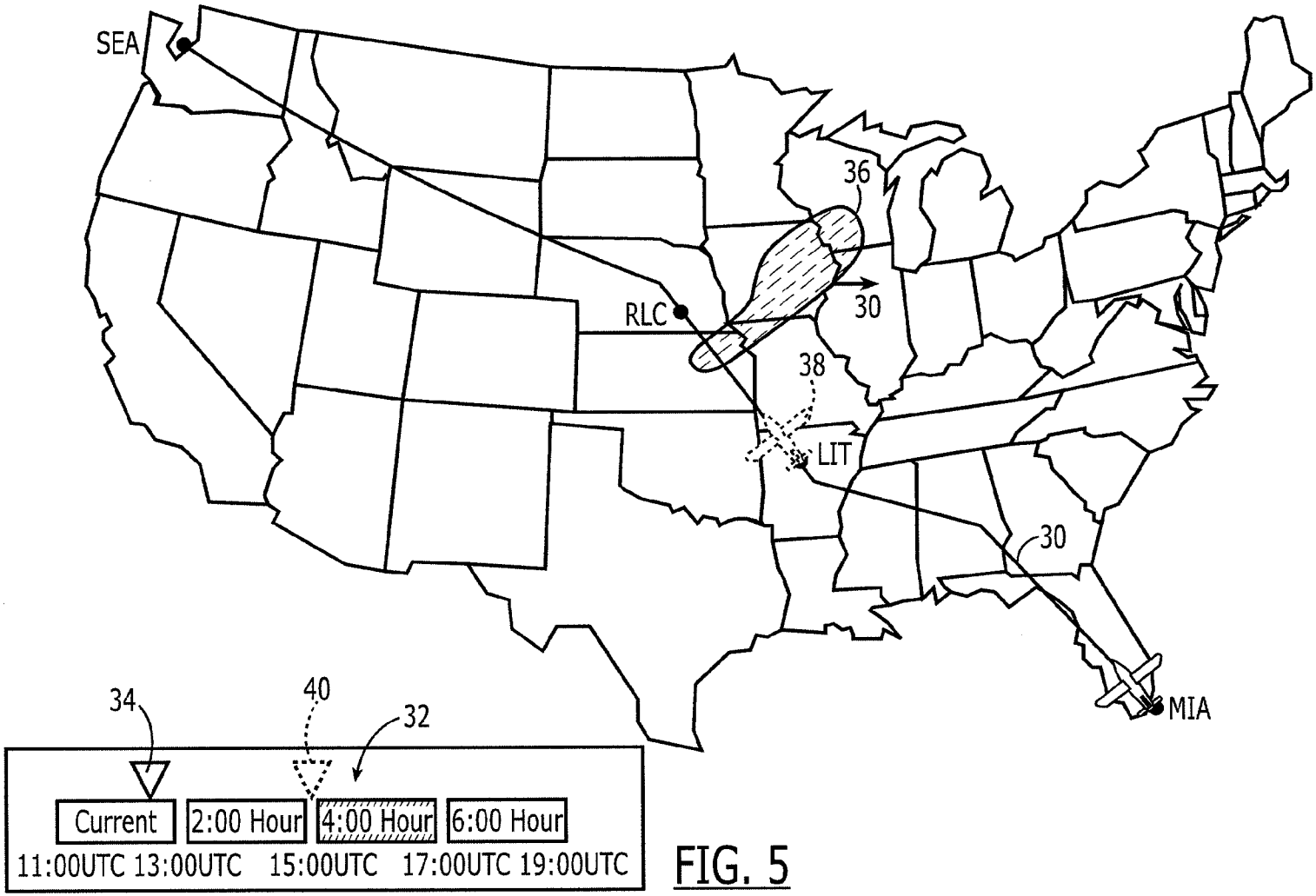
Figure 6:
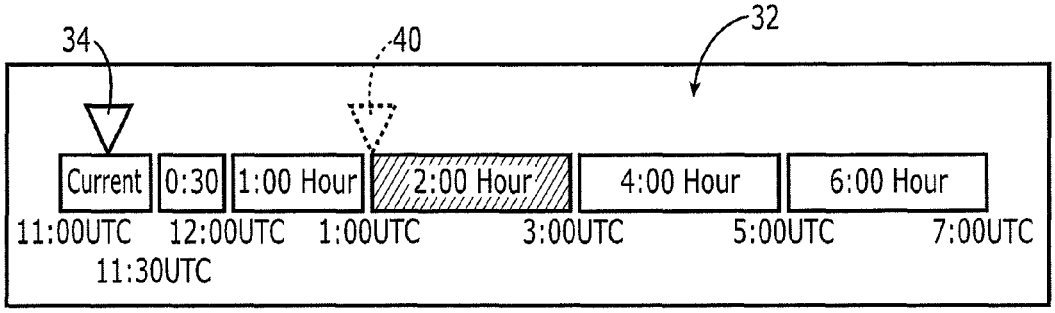
Figure 7:
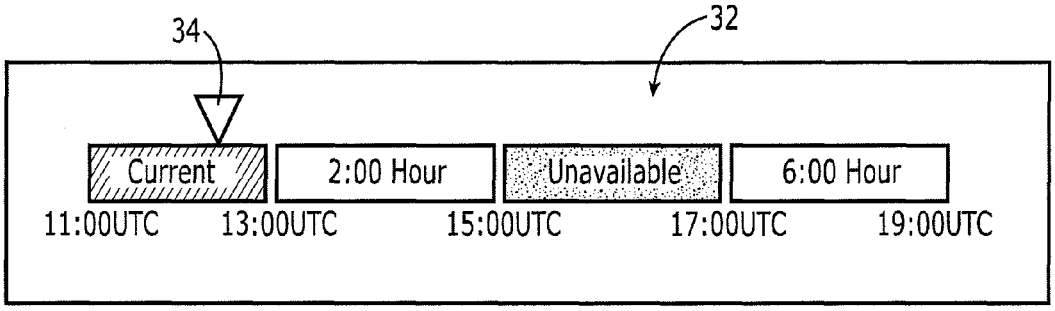
Figure 8:
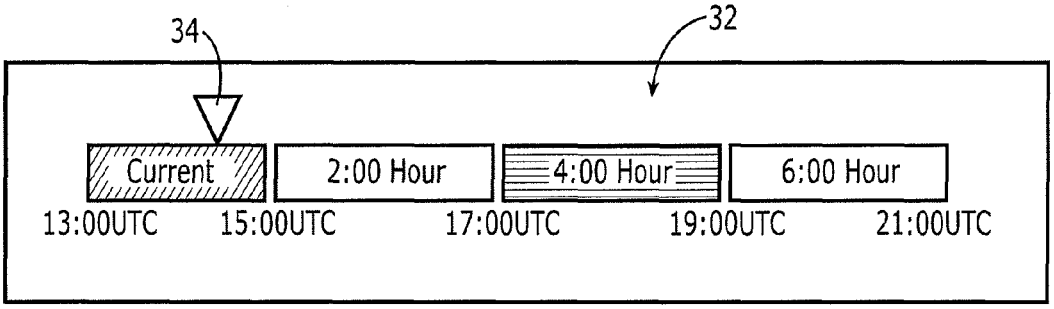
Figure 9:
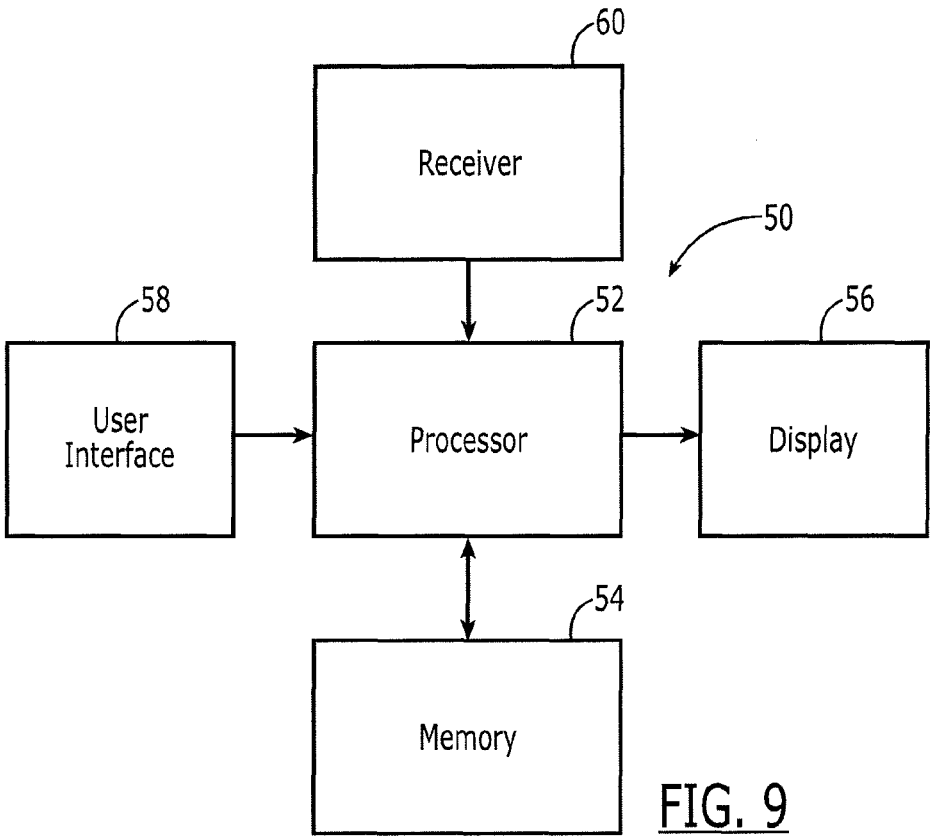

Having thus described certain embodiments in general terms, reference will now be made to the accompanying drawings, which are not necessarily drawn to scale, and wherein:

FIG. 1 is a schematic representation of a system by which an air vehicle is provided a plurality of weather products in accordance with one embodiment of the present disclosure;

FIG. 2 is a flow chart illustrating the operations performed in accordance with one embodiment of the present disclosure;

FIG. 3 is a display of a forecast weather product in relation to the planned flight path of an air vehicle during a first time period in accordance with embodiments of the present disclosure;

FIG. 4 is a display of a forecast weather product in relation to the planned flight path of an air vehicle during a second time period in accordance with embodiments of the present disclosure;

FIG. 5 is a display of a forecast weather product in relation to the planned flight path of an air vehicle during a third time period in accordance with embodiments of the present disclosure;

FIG. 6 is a graphical representation of the different time periods associated with a plurality of weather products in which the time periods have different lengths in accordance with one embodiment of the present disclosure;

FIG. 7 is a graphical representation of the different time periods associated with a plurality of weather products in which a weather product is unavailable for one of the time periods in accordance with one embodiment of the present disclosure;

FIG. 8 is a graphical representation of the different time periods associated with the plurality of weather products in which one of the time periods is associated with a weather product from a prior set of weather products in accordance with one embodiment of the present disclosure; and FIG. 9 is a block diagram of an apparatus in accordance with one embodiment of the present disclosure.

DETAILED DESCRIPTION

Embodiments of the present disclosure now will be described more fully hereinafter with reference to the accompanying drawings, in which some, but not all embodiments of the disclosure are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1 and block 20 of FIG. 2, an air vehicle 10, such as an aircraft, may receive forecast weather products prior to its departure and while en route along a planned flight path to its destination. An aircraft may receive the forecast weather products from a variety of sources and in a variety of manners. Prior to its departure, a set of forecast weather products is generally provided to the air vehicle for review by the crew. The weather products may be provided via either wired or wireless communications. Once en route, however, as shown in FIG. 1, an aircraft may be in communication with one or more ground stations or other weather stations. These stations may provide updated forecast weather products via wireless communications. These updated forecast weather products may be provided at various instances in time, such as periodically, e.g., every two hours, every thirty minutes or the like, and may be either pushed by the ground or weather station to the aircraft or may be requested by the aircraft.

A set of forecast weather products generally includes a plurality of weather products that provide information regarding the anticipated weather conditions associated with the planned flight path of the air vehicle 10. Each weather product of a set of weather products is generally associated with and valid for a different time period. In this regard, each weather product is generally valid for a predefined time period. As described below, each weather product of a set of weather products may be valid for a respective time period having the same length of time or may be valid for time periods that differ from one another. By way of example, for a flight that is scheduled to depart from Miami at 12:00 noon Eastern Time and to arrive in Seattle, Wash. at 5:30 p.m. Eastern Time, the set of weather products of one embodiment may include a first weather product that is valid from 11:00 a.m. Eastern Time until 1:00 p.m. Eastern Time, a second weather product that is valid from 1:00 p.m. Eastern Time until 3:00 p.m. Eastern Time, a third weather product that is valid from 3:00 p.m. Eastern Time until 5:00 p.m. Eastern Time and a fourth weather product that is valid from 5:00 p.m. Eastern Time until 7:00 p.m. Eastern Time. As such, the entire time period during which the air vehicle is anticipated to be en route from the origin to the destination is encompassed by the set of weather products.

The plurality of weather products generally provide weather information indicative of the anticipated weather conditions associated with the planned flight. The forecast weather products of one embodiment include weather information relevant to a region through which the planned flight path extends including, for example a region that extends a predefined distance on either side of the planned flight path. As such, the forecast weather products provide weather information to the crew of the air vehicle 10 regarding the weather conditions on the planned flight path as well as weather conditions in the near vicinity of the planned flight path such that the crew may take appropriate measures to accommodate the anticipated weather conditions. Various weather products are available with one example of a weather product being the Collaborative Convective Forecast Product (CCFP). In addition to the weather products, the air vehicle 10 may receive the current date and time and/or updated position information for the air vehicle from other systems onboard the air vehicle. See, for example, blocks 21 and 22 of FIG. 2. The current date and time and/or the updated position information may then be stored, such as in memory 54 as shown in FIG. 9 and described below. As illustrated in FIGS. 3-5, the apparatus of embodiments of the present disclosure may provide for a display of the planned flight path 30 of the air vehicle 10 and a representation of the forecast weather products relative to the planned flight path during a respective time period during which the air vehicle is anticipated to be flying along the planned flight path. For example, the image may be displayed on one or more of the displays included in the cockpit of the air vehicle. As shown in block 24 of FIG. 2 and in FIGS. 3-5, the display may include a representation 32 of the different time periods associated with the plurality of weather products. The different time periods may be represented in different manners, such as in different graphical manners, but are depicted by respective buttons in the illustrated embodiment. In this regard, each button is associated with a different time period, and each time period, in turn, is associated with a different one of the plurality of weather products. Although each weather product of a particular set of weather products may be associated with different time periods having different lengths, the weather products of the illustrated embodiments are each valid for a two-hour period, with a first weather product being valid from 1100 to 1300 UTC time, a second weather product being valid from 1300 to 1500 UTC time, a third weather product being valid from 1500 to 1700 UTC time and a fourth weather product being valid from 1700 to 1900 UTC time. Since the plurality of weather products of this example initially became valid at 1100 UTC time, the second, third and fourth weather products may be designated as the two-hour, four-hour and six-hour weather products, respectively, based upon the time difference between the time at which the plurality of weather products initially become valid and the time at which the second, third and fourth weather products become valid.

A graphical representation 34 of the current time may also be displayed in relation to the representation 32 of different time periods associated with the plurality of weather products. See block 25 of FIG. 2. In the illustrated embodiment, for example, the solid triangle positioned above the buttons that represent the plurality of weather products represents the current time. As will be apparent, the representation of the current time will generally move from the left to the right in the illustrated embodiment in recognition that the current time will advance through the plurality of weather products over the course of time. Since the current time in the illustrated embodiment is about 1230 UTC time, the first weather product is valid. In order to distinguish the representation of the time period that is currently valid from the representation of other time periods, the graphical representation of the time period that is currently valid may be different than the graphical representations of the other time periods. For example, the representation of the time period that is currently valid may be shaded or colored in a different fashion and/or may be designated with a particular legend, such as "Current" in the illustrated embodiment.

Following the display of the representation 32 of the different time periods associated with the plurality of weather products, a check may be preformed to determine if a selection of a time period has been received and, when a selection of a time period associated with a respective weather product has been received, an appropriate display may be generated. See blocks 26 and 27 of FIG. 2. Alternatively, if no selection is made, the process may be repeated as shown in FIG. 2 to permit further updated weather products and other information to be received and utilized in conjunction with a subsequent selection. The selection may be provided in various manners. For example, a crew member may click on the representation of a time period that is associated with the desired weather product in order to select the respective time period. With reference to FIG. 4, for example, the second time period designated "2:00 Hour" has been selected. Following the selection, the selection may be adjusted, if necessary, based on the progression of the current time and/or the availability of updated weather products, as shown in block 28 of FIG. 2. Then, a representation 36 of the respective weather product that is associated with the selected time period is displayed. See also block 29 of FIG. 2. In this regard, a representation of the weather product that is valid between 1300 and 1500 UTC time is displayed in relation to the planned flight path 30. The weather product may be represented in a variety of manners. For example, a shape may be defined which bounds a particular type of weather condition, such as rain, hail, snow, high winds or the like. The shape may then be crosshatched with the type of crosshatching being representative of the particular weather condition. The representation of the respective weather product may also include additional information, such as a directional indicator, e.g., the rightwardly pointing arrow in the embodiment of FIG. 4, to illustrate the direction of movement of the weather conditions and alphanumeric characters to provide additional information. For example, the speed at which the weather conditions are moving and the indicated direction of motion may be provided, such as 25 knots in an easterly direction as noted in the embodiment of FIG. 4.

In addition to displaying the representation 36 of the respective weather product in relation to the planned flight path 30, a representation 38 of an anticipated location of the air vehicle 10 relative to the planned flight path during the time period that has been selected is also provided. See block 29 of FIG. 2. The representation of the anticipated location of the air vehicle during the selected time period may be represented in various fashions, but is shown by an airplane icon 38 that is formed with dashed lines in the embodiments of FIGS. 4 and 5. By depicting the anticipated location of the air vehicle during the selected time period, the crew is provided with contextual information that permits the crew to efficiently determine the likely impact, if any, of the weather conditions upon the air vehicle during the selected time period. Although the anticipated location of the air vehicle during the selected time period may be determined in various fashions, the flight management system (FMS) of an air vehicle may provide the anticipated location of the air vehicle in response to a request for such information that includes the time period that has been selected.

In addition to providing a representation 34 of the current time relative to the different time periods that are associated with the plurality of weather products, a representation 40 of the time that is associated with the weather product that is currently being displayed may also be provided in relation to the representations 32 of the different time periods in instances in which the selected time period is in advance of the current time, such as shown in FIGS. 4 and 5. In regard to the embodiment of FIG. 4, a triangle formed of dashed lines depicts the time, that is, 1300 UTC time, associated with the weather product that is currently being displayed. In order to highlight the time period that has been selected, the representation of the selected time period may differ from the other time periods that have not been selected, such as in terms of coloring, shading or the like, e.g., cross-hatching in the embodiment of FIG. 4.

In order to illustrate the different displays that may be provided as different time periods that are associated with different weather products are selected, FIGS. 3, 4 and 5 illustrate three different weather products from a common set of weather products, with the three different weather products becoming valid at 1100 UTC time, 1300 UTC time, and 1500 UTC time, respectively. As shown from a comparison of FIGS. 3-5, the weather conditions are moving in an easterly direction while the air vehicle 10 is planned to move in a northwesterly direction along the planned flight path 30 as represented by the airplane icon 38.

As noted above, the display that is provided may be changed by the selection of a different time period. However, the display may also be changed by selecting the icon 40 representative of the time associated with the predicted aircraft position 38 and then moving the icon, such as by dragging the icon, relative to the timeline set forth by the representations 32 of the different time periods. Relative to the display depicted in FIG. 4, the triangular icon 40 formed of dashed lines may be dragged to the right across the second time period that extends between 1300 and 1500 UTC time. As a result of the movement of the icon, the time associated with the repositioned icon may be determined, and the predicted location of the air vehicle at that time may be determined. As such, an updated representation 38 of the position of the air vehicle relative to the planned flight path 30 at the time associated with the repositioned icon may then be displayed. Thus, movement of the icon across all or a portion of a respective time period will cause the representation of the air vehicle to move along the planned flight path in a corresponding fashion.

Since the same weather product is generally valid during the entirety of the respective time period, the representation 36 of the weather product does not generally change while the icon 40 representative of the selected time is moved across a single time period. However, upon movement of the icon representative of the selected time from one time period to another time period, such as from the second time period extending between 1300 and 1500 UTC time to the third time period extending between 1500 and 1700 UTC time, the representation of the weather product would also change from that shown in FIG. 4 to that shown in FIG. 5 such that as the icon is moved to any time between 1500 and 1700 UTC time, the weather product corresponding to that particular time period is appropriately represented by the display as shown in FIG. 5. While the time that is selected may be altered manually, such as by the selection and dragging of the icon representative of the selected time relative to the representation of the plurality of time periods, the method and apparatus of one embodiment may automatically cycle the selected time through a predefined sequence, such as by automatically moving the selected time from the time at which the air vehicle is scheduled to depart to the time at which the air vehicle 10 is scheduled to arrive at its destination in order to display a representation of the manner in which the weather conditions will evolve on a relatively continuous basis over the course of a flight.

In the foregoing embodiments, each time period associated with the plurality of weather products has the same length, e.g., two hours. However, the time periods associated with the plurality of available weather products may have different lengths. For example, the time periods associated with the CCFP weather products may differ. In instances in which the time periods associated with the plurality of weather products have different lengths, the display of the representation 32 of the different time periods may include a graphical representation of the different lengths of the time periods associated with the plurality of weather products. By way of example, FIG. 6 depicts the representation of the time periods associated with the plurality of weather products in which the time periods closer to the current time are shorter in length, e.g., thirty minutes for the time periods between 1100 and 1130 UTC time and 1130 and 1200 UTC time and one hour for the time period between 1200 and 1300 UTC time, while the time periods that are associated with later forecast periods are longer, e.g., two hours. The different lengths of the time periods may be graphically represented in various manners, but, in the illustrated embodiment, the buttons associated with the different time periods have widths that correspond to the relative lengths of the respective time periods with the widths of the button associated with one-hour time period being half as wide as the width of the buttons associated with the two-hour time periods and the buttons associated with the thirty minute time periods being one quarter of the width of the buttons associated with the two-hour time periods.

In the embodiments described above, the plurality of weather products include weather products for each of a number of contiguous time periods. In some embodiments, however, a weather product may be unavailable for one of the time periods, even though weather products are available for the other time periods. In this instance, different graphical indicia may be associated with the representation 32 of the different time periods to provide different graphical representations of a time period for which a respective weather product is available and of another time period for which the respective weather product is unavailable. With reference to FIG. 7, for example, the third weather product that would otherwise have been valid between 1500 and 1700 UTC time is unavailable, but the first, second and fourth weather products that are valid from 1100 to 1300 UTC time, 1300 to 1500 UTC time and 1700 to 1900 UTC time, respectively, are available. As such, the graphical representation of the third time period may differ from the graphical representation of the other time periods, such as by shading, coloring, labeling or the like, in order to provide an indication that may be quickly noted by a crew member of the time periods for which weather products are available and the time periods for which weather products are unavailable.

As discussed above in conjunction with FIG. 1, the air vehicle 10 may repeatedly receive updated sets of weather products, such as periodically both prior to its departure and then throughout the flight. For example, the air vehicle may receive a first set of weather products at a first time, a second set of weather products at a subsequent second time and then other subsequent sets of weather products at later respective times. Typically, once an updated set of weather products has been received, the display will be generated based upon the updated set of weather products, instead of the prior set of weather products, in order to provide the most up-to-date information. In some instances, however, the updated set of weather products may fail to include a weather product for one of the time periods. As opposed to merely indicating that the weather product is unavailable for the respective time period as shown, for example, in FIG. 7, the weather product for the same respective time period (the time period for which an updated weather product is unavailable) from the prior set of weather products, e.g., the first set of weather products, may be utilized in conjunction with the other updated weather products in order to provide more fulsome information. By way of example, the first set of weather products may include weather products associated with each of four time periods, that is, a first time period from 1100 to 1300 UTC time, a second time period from 1300 to 1500 UTC time, a third time period from 1500 to 1700 UTC time and a fourth time period from 1700 to 1900 UTC time. In this example, a new set of updated weather products may be thereafter received, but the new set of weather products may only include weather products associated with the periods from 1300 to 1500 UTC time, 1500 to 1700 UTC time and 1900 to 2100 UTC time. As will be noted, the new set of weather products does not include a weather product from the period from 1700 to 1900 UTC time. As such, the weather product for the third time period of the first set of weather products, i.e., 1700 to 1900 UTC time, may be utilized and may also serve as the weather product associated with the 1700 to 1900 UTC time period for the second set of weather products. Although a weather product from the immediately preceding set of weather products is employed in the foregoing example, a corresponding weather product, i.e., a weather product for the same UTC time period, may be provided by any preceding set of weather products.

The representation 32 of the time periods associated with the weather products may be provided in such a manner to alert a crew member that the weather product associated with one or more time periods has not been updated, but is instead dependent upon the weather product from a prior set of weather products. For example, the time period associated with the weather product that is being recycled from the prior set of weather products may be graphically represented in a variety of manners that differ from the representations of the other time periods, such as in terms of color, shading, labeling or the like. With respect to FIG. 8, for example, the time period associated with the recycled weather product that is valid from 1700 to 1900 UTC time may be differently cross-hatched.

The method of displaying forecast weather products in relation to a planned flight path 30 may be automated and, as such, may be implemented by a computer 50, such as depicted in FIG. 9. In this regard, the computer of FIG. 9 includes processing circuitry that is configured to perform data processing, application execution and other processing and management services according to an exemplary embodiment of the present disclosure. For example, the processing circuitry may receive the weather products, provide the appropriate displays and receive user selections as described above and as shown in operations 20-29 of FIG. 2. The processing circuitry may be embodied as a circuit chip (e.g., an integrated circuit chip) configured (e.g., with hardware, software or a combination of hardware and software) to perform operations described herein. However, in some embodiments, the processing circuitry may be embodied as a portion of a server, computer, laptop, workstation, flight control computer or any one or more of various other computing devices.

In an exemplary embodiment, the computer 50 of FIG. 9 also includes one or more memory devices 54 such as, for example, volatile and/or non-volatile memory that may be either fixed or removable. The memory devices may be configured to store information, data, applications, instructions or the like for enabling the processing circuitry to carry out various functions in accordance with exemplary embodiments of the present disclosure. For example, the memory device could be configured to buffer input data for processing by the processing circuitry and to store the weather products that are periodically provided as well as the current date and time and/or the updated position information. Additionally or alternatively, the memory device could be configured to store instructions for execution by the processing circuitry.

The computer 50 can also include a display 56 for presenting the displays of FIGS. 3-5, for example. Additionally, the computer can include a user interface 58 for receiving input from a user, such as the selection of a time period and/or movement of an icon 40 representative of the selected time. As such, the user interface may include, for example, a keyboard, a mouse, a cursor control device, a joystick, a touch screen display, a conventional display, a microphone, a speaker, or other input/output mechanisms.

In one embodiment, the processing circuitry may include a processor 52. The processor may be embodied in a number of different ways. For example, the processor may be embodied as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an exemplary embodiment, the processor may be configured to execute instructions stored in the memory device 54 or otherwise accessible to the processor. As such, whether configured by hardware or software methods, or by a combination thereof, the processor may represent an entity (e.g., physically embodied in circuitry) capable of performing operations according to embodiments of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the operations described herein.

Embodiments of method and apparatus of the present disclosure may therefore be practiced using a computer 50 such as depicted in FIG. 9. However, other embodiments may be practiced in connection with a computer program product configured to perform in accordance with embodiments of the present disclosure. In this regard, FIG. 2, as described above, is an illustration of a method and program product according to exemplary embodiments. Each block or step of FIG. 2, and combinations of blocks in FIG. 2, may be implemented by various means, such as hardware, firmware, processor, circuitry and/or another device associated with execution of software including one or more computer program instructions. Thus, for example, one or more of the procedures described above may be embodied by computer program instructions, which may embody the procedures described above and may be stored by a storage device (e.g., memory device 54) and executed by processing circuitry (e.g., processor 52). Further, the computer may include or be associated with a receiver 60, including, in one embodiment, a data link radio, configured to receive sets of weather products and/or updated information regarding the current date and time and/or the position of the air vehicle and the planned route of the air vehicle.

As will be appreciated, any such stored computer program instructions may be loaded onto a computer or other programmable apparatus (i.e., hardware) to produce a machine, such that the instructions which execute on the computer or other programmable apparatus implement the functions specified in the flowchart block(s) or step(s). These computer program instructions may also be stored in a computer-readable medium comprising memory that may direct a computer or other programmable apparatus to function in a particular manner, such that the instructions stored in the computer-readable memory produce an article of manufacture including instructions to implement the function specified in the flowchart block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowchart block(s) or step(s).

Many modifications and other embodiments of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific embodiments discussed above and that modifications and other embodiments are intended to be included within the scope of the appended claims. Although specific terms are employed herein, they are used in a generic and descriptive sense only and not for purposes of limitation.

That which is claimed:

1. A method of displaying forecast weather products, the method comprising:

receiving a plurality of weather products, each weather product being associated with a different time period;

providing for a display of a representation of the different time periods associated with the plurality of weather products, wherein providing for the display of the representation of the different time periods comprises associating different graphical indicia with the representation of the different time periods to provide different graphical representations of a time period for which the respective weather product is available and of another time period for which the respective weather product is unavailable;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

2. The method according to claim 1 further comprising providing for a display of a graphical representation of a forecast time in relation to the representation of the different time periods associated with the plurality of weather products, wherein the forecast time is associated with the time period associated with the weather product being displayed.

3. The computer program product according to claim 2 further comprising receiving an input moving the graphical representation of the forecast time relative to the representation of the different time periods associated with the plurality of weather products, wherein providing for the display of the representation of the anticipated location of the air vehicle comprises providing for movement of the representation of the anticipated location of the air vehicle along the planned flight path based upon and in correspondence to movement of the graphical representation of the forecast time.

4. The method according to claim 1 further comprises providing for a display of a representation of a current location of the air vehicle relative to the planned flight path.

5. A method of displaying forecast weather products, the method comprising:

receiving a plurality of weather products, each weather product being associated with a different time period, wherein receiving a plurality of weather products comprises receiving at least two sets of weather products at respective times, and wherein the method comprises providing for a display of a representation of the different time periods associated with the plurality of weather products;

inserting a weather product of one set associated with a respective time period into a subsequent set to serve as the weather product associated with the same respective time period when the subsequent set of weather products that is received fails to include a weather product associated with the respective time period;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

6. A method of displaying forecast weather products, the method comprising:

receiving a plurality of weather products, each weather product being associated with a different time period, wherein the time periods associated with the plurality of weather products have different lengths;

providing for a display of a representation of the different time periods associated with the plurality of weather products, wherein providing for the display of the representation of the different time periods comprises graphically representing the different lengths of the time periods associated with the plurality of weather products;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

7. An apparatus for displaying forecast weather products, the apparatus comprising:

a memory configured to store a plurality of weather products, each weather product being associated with a different time period; and a processor, responsive to the memory, configured to provide for a display of a representation of the different time periods associated with the plurality of weather products by associating different graphical indicia with the representation of the different time periods to provide different graphical representations of a time period for which the respective weather product is available and of another time period for which the respective weather product is unavailable, said processor also configured to receive a selection of a time period associated with a respective weather product, said processor further configured to provide for a display of a representation of the respective weather product in relation to a planned flight path of an air vehicle and a representation of an anticipated location of the air vehicle relative to the planned flight path during the time period that has been selected.

8. The apparatus according to claim 7 wherein the processor is further configured to provide for a display of a graphical representation of a forecast time in relation to the representation of the different time periods associated with the plurality of weather products, wherein the forecast time is associated with the time period associated with the weather product being displayed.

9. The apparatus according to claim 8 wherein the processor is further configured to receive an input moving the graphical representation of the forecast time relative to the representation of the different time periods associated with the plurality of weather products, wherein the processor is also configured to provide for the display of the representation of the anticipated location of the air vehicle by providing for movement of the representation of the anticipated location of the air vehicle along the planned flight path based upon and in correspondence to movement of the graphical representation of the forecast time.

10. An apparatus for displaying forecast weather products, the apparatus comprising:

a memory configured to store a plurality of weather products, each weather product being associated with a different time period; and a processor, responsive to the memory, configured to provide for a display of a representation of the different time periods associated with the plurality of weather products, wherein the processor is configured to receive a plurality of weather products by receiving at least two sets of weather products at respective times, and wherein the processor is further configured to insert a weather product of one set associated with a respective time period into a subsequent set to serve as the weather product associated with the same respective time period when the subsequent set of weather products that is received fails to include a weather product associated with the respective time period, wherein said processor is also configured to receive a selection of a time period associated with a respective weather product, and wherein said processor is further configured to provide for a display of a representation of the respective weather product in relation to a planned flight path of an air vehicle and a representation of an anticipated location of the air vehicle relative to the planned flight path during the time period that has been selected.

11. An apparatus for displaying forecast weather products, the apparatus comprising:

a memory configured to store a plurality of weather products, each weather product being associated with a different time period, wherein the time periods associated with the plurality of weather products have different lengths; and a processor, responsive to the memory, configured to provide for a display of a representation of the different time periods associated with the plurality of weather products, wherein the processor is configured to provide for the display of the representation of the different time periods by graphically representing the different lengths of the time periods associated with the plurality of weather products, wherein said processor is also configured to receive a selection of a time period associated with a respective weather product, and wherein said processor is further configured to provide for a display of a representation of the respective weather product in relation to a planned flight path of an air vehicle and a representation of an anticipated location of the air vehicle relative to the planned flight path during the time period that has been selected.

12. A computer program product for displaying forecast weather products, the computer program product comprising at least one computer-readable storage medium having computer-readable program code portions stored therein that in response to execution by a processor, cause an apparatus to at least perform the following:

receiving a plurality of weather products, each weather product being associated with a different time period;

providing for a display of a representation of the different time periods associated with the plurality of weather products, wherein providing for the display of the representation of the different time periods comprises associating different graphical indicia with the representation of the different time periods to provide different graphical representations of a time period for which the respective weather product is available and of another time period for which the respective weather product is unavailable;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

13. The computer program product according to claim 12 further comprising computer-readable program code portions that in response to execution by the processor, cause the apparatus to provide for a display of a graphical representation of a forecast time in relation to the representation of the different time periods associated with the plurality of weather products, wherein the forecast time is associated with the time period associated with the weather product being displayed.

14. The computer program product according to claim 13 further comprising computer-readable program code portions that in response to execution by the processor, cause the apparatus to receive an input moving the graphical representation of the forecast time relative to the representation of the different time periods associated with the plurality of weather products, wherein providing for the display of the representation of the anticipated location of the air vehicle comprises providing for movement of the representation of the anticipated location of the air vehicle along the planned flight path based upon and in correspondence to movement of the graphical representation of the forecast time.

15. A computer program product for displaying forecast weather products, the computer program product comprising at least one computer-readable storage medium having computer-readable program code portions stored therein that in response to execution by a processor, cause an apparatus to at least perform the following:

receiving a plurality of weather products, each weather product being associated with a different time period, wherein receiving a plurality of weather products comprises receiving at least two sets of weather products at respective times;

providing for a display of a representation of the different time periods associated with the plurality of weather products;

inserting a weather product of one set associated with a respective time period into a subsequent set to serve as the weather product associated with the same respective time period when the subsequent set of weather products that is received fails to include a weather product associated with the respective time period;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

16. A computer program product for displaying forecast weather products, the computer program product comprising at least one computer-readable storage medium having computer-readable program code portions stored therein that in response to execution by a processor, cause an apparatus to at least perform the following:

receiving a plurality of weather products, each weather product being associated with a different time period, wherein the time periods associated with the plurality of weather products have different lengths;

providing for a display of a representation of the different time periods associated with the plurality of weather products, and wherein providing for the display of the representation of the different time periods comprises graphically representing the different lengths of the time periods associated with the plurality of weather products;

receiving a selection of a time period associated with a respective weather product; and providing for a display of a representation of the respective weather product in relation to a planned flight path of an air vehicle and a representation of an anticipated location of the air vehicle relative to the planned flight path during the time period that has been selected.

* * * * *